US005839480A

United States Patent [19]

Sarfati

[11] Patent Number: 5,839,480

[45] Date of Patent: Nov. 24, 1998

[54] THREAD STORAGE DEVICE WITH ADJUSTABLE THREAD EYE AND BRAKE RING

[75] Inventor: Alberto Gustavo Sarfati, Como, Italy

[73] Assignee: Sobrevin Société de brevets industriels-Etablissement, Vaduz, Liechtenstein

[21] Appl. No.: 739,651

[22] Filed: Oct. 30, 1996

Related U.S. Application Data

[63] Continuation of Ser. No. 431,047, Apr. 28, 1995, Pat. No. 5,582,214.

[30] Foreign Application Priority Data

May 2, 1994 [DE] Germany ..... 44 15 331.7

[51] Int. Cl.[6] ..... D03D 47/36

[52] U.S. Cl. ..... 139/452; 242/47.01

[58] Field of Search ..... 139/452; 242/47.01

[56] References Cited

U.S. PATENT DOCUMENTS

| | | | |
|---|---|---|---|
| 4,429,723 | 2/1984 | Maroino | 139/452 |
| 4,926,912 | 5/1990 | Zenoni | 139/452 |
| 5,316,051 | 5/1994 | Zenoni et al. | 139/452 |
| 5,570,593 | 11/1996 | Neher et al. | 242/47.01 |

FOREIGN PATENT DOCUMENTS

| | | | |
|---|---|---|---|
| 0 049 897 | 4/1982 | European Pat. Off. . | |
| 0239055 | 9/1987 | European Pat. Off. | 139/452 |
| 0401699 | 12/1990 | European Pat. Off. . | |
| 0536008 | 4/1993 | European Pat. Off. | 139/452 |
| 1572175 | 11/1967 | France . | |
| 1572175 | 6/1969 | France . | |
| 2028543 | 6/1970 | Germany | 139/452 |
| 2716017 | 8/1978 | Germany . | |
| 3006277 | 4/1993 | WIPO | 139/452 |
| 94/20492 | 9/1994 | WIPO . | |

*Primary Examiner*—Andy Falik
*Attorney, Agent, or Firm*—Martin A. Farber

[57] ABSTRACT

A thread storage device having a storage drum (1) from which a supply of thread can be withdrawn overhead through a thread take-off eye (5) which is arranged spaced from the end (1') of the drum and having a brake ring (8) which is arranged coaxial to the storage drum, with brake member (2) acting on an edge region (4) of the drum on the thread take-off side, the axial position of the thread take-off eye (5) and brake ring (8) being adjustable relative to the storage drum. In order to be able to effect a finer adjustment of the braking action, the thread take-off eye (5) is displaceable in axial direction relative to the brake ring (8) in such a manner that, with constant brake action of the brake member (2) which merely prevents ballooning, the thread application (alpha 1, alpha 2) on a radially inwardly curved section (3) of the drum is adjustable.

1 Claim, 3 Drawing Sheets

THREAD STORAGE DEVICE WITH ADJUSTABLE THREAD EYE AND BRAKE RING

This is a continuation of my prior application Ser. No. 08/431,047 filed Apr. 28, 1995 (now U.S. Pat. No. 5,582, 214).

FIELD AND BACKGROUND OF THE INVENTION

The present invention relates to a thread storage device in general, and to a thread storage device having a storage drum from which a supply of thread can be withdrawn at its top through a thread take-off eye spaced from the end of the drum, and a brake ring coaxial to the storage drum, with a brake member acting on an edge region of the drum on the thread take-off side, the axial position of the thread take-off eye and brake ring relative to the storage drum being adjustable, in particular.

Such a device is known from U.S. Pat. No. 4,429,723 or EP 0 401 699. With the thread storage device of this type, the take-off tension of the thread is produced by axial displacement of a brake ring. The brake ring has a brake member. In the prior art, this brake member is formed of a plurality of blades which are directed radially towards the inside and lie on an end edge of the storage drum, so that the thread is pulled between the blades and the region of the edge of the storage drum. The brake ring is displaceable axially to the storage drum together with a thread take-off eye. In the prior art, the force of the application of the brake member against the edge region of the drum and thus the tension of the thread are varied by the axial displacement of the brake ring.

From German Provisional Patent 27 16 017, a thread storage is known in which the brake force is to be controlled by axial displaceability of a take-off eye. The adjustment of the brake ring in that case is, to be sure, not sufficiently sensitive and the change in the brake force produced by the axial displacement is not optimal.

SUMMARY OF THE INVENTION

It is an object of the present invention to improve a device of the type set forth in the introductorily-mentioned paragraph above in a manner which is advantageous in use.

As a result of the development in accordance with the invention, a thread storage device is created in which the axial position of thread take-off eye and brake ring is adjustable not only relative to the storage drum but also relative to each other. The displacement of the axial position of the thread take-off eye can be effected without impairing the braking action of the brake member. As a result of the adjustability of the brake member a minimum braking action which is just sufficient to prevent the formation of a balloon can be established. Surprisingly, it is then possible, together with a radially inwardly curved section of the drum solely for the application of the thread, to produce, by the axial adjustability of the take-off eye, a second brake member which can be finely adjusted by itself. It is preferably provided that, with the brake member resting with minimum tension on the edge of the drum, the thread take-off eye is varied in such a manner that, depending on the axial position of the eye, the thread is pulled at a different angle over the radially inwardly curved section of the drum. The rubbing and thus the braking of the thread are thereby changed accordingly. The closer the distance of the thread take-off eye from the end of the drum, the larger the angle with which the thread rests on the curved section of the drum. The rubbing increases accordingly. The angular region in which the thread rests on the rounded section of the take-off eye changes in the same way upon varying the distance between take-off eye and drum, so that in this case also, the friction is increased upon increase of the angle of application. In this device, the brake member need rest on the drum only with the application of a minimum constant force and the braking action need only be so great that the formation of a balloon is prevented. It is even possible for the brake member to be spaced from the drum by the forming of a slot. The take-off eye is preferably displaceable axially by motor drive. It can be displaced by an electromagnet or by an electric motor. The displacement is preferably effected in synchronism with the introduction of the filling thread into a loom. The control of the thread brake can be effected in this connection from the loom. A preferred embodiment of the invention provides that the brake member be developed as a flexible funnel which is urged by spring action towards the outside in the direction of the normal to its surface. This funnel is preferably formed of an internally smooth strip of metal which surrounds the region of the front edge of the drum. The thread is withdrawn between its inner surface and the outer surface of the region of the front edge of the drum. The brake ring lies on the edge region of the drum under slight spring tension. The drum-side mating surface for the ring can either be toroidal, i.e. curved radially inward, or frustoconical. In this connection, the cone angle of the brake member may be an acute angle. The cone angle of the drum-side mating surface corresponds in this case to the cone angle of the brake member. The two brake parts then lie flat against each other. The spring action on the brake strip can in this case be exerted by means of an elastic body of foam surrounding the brake strip. However, a coil spring or the like which acts in axial direction can also be used. The furthest position of the take-off eye from the end of the drum should preferably lie at the theoretical tip of the cone surface developed by the inner surface of the brake member. In this way, assurance is had that, upon the pulling-off of the thread, a pull which is tangential to the brake surface is maximally assured. A lifting-off of the brake member as a result of the thread tension is thus prevented. The brake member then lifts off from the edge of the drum merely by an amount equal to the thickness of the thread. In accordance with a special further development of the invention which can also be of independent importance, the take-off eye is displaceable in the plane perpendicular to the axis of the drum. By this measure, periodic variations of the tension of the thread can, among other things, be obtained. Depending on the angular position of the thread, it lies with a different angle on the inwardly rounded region of the drum and has a different take-off tension.

BRIEF DESCRIPTION OF THE DRAWINGS

With the above and other objects and advantages in view, the present invention will become more clearly understood in connection with the detailed description of preferred embodiments when considered with the accompanying drawings, of which.

DETAILED DESCRIPTION OF THE PREFERRED EMBODIMENTS

Figures 1, 2:
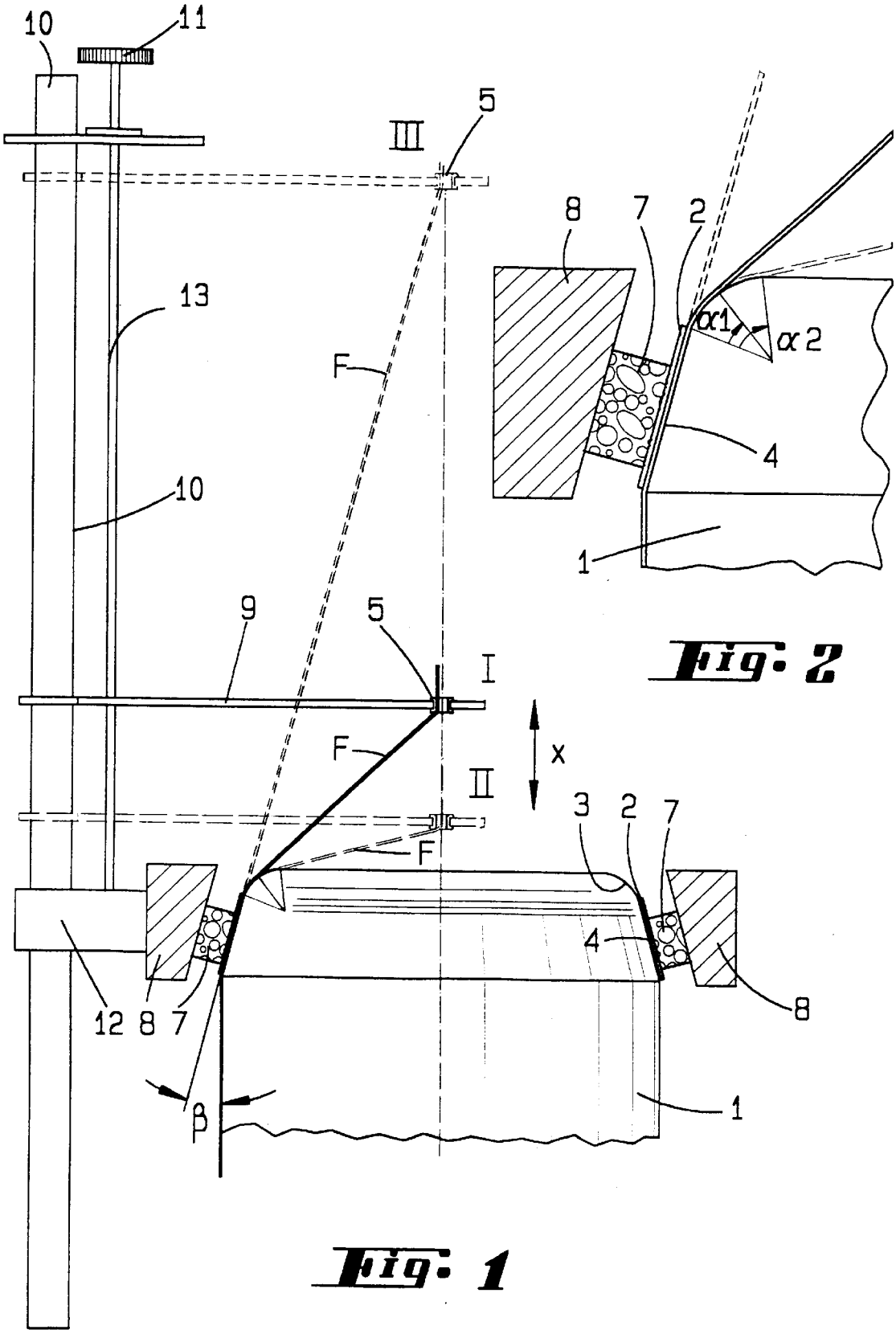
FIG. 1 shows an elevational view of a first embodiment of the invention broken away and sectioned in part.
FIG. 2 shows an enlarged portion of FIG. 1.

The thread storage device shown in FIG. 1 or FIG. 2 has a storage drum 1 in which a thread is wound in known manner (see EP 0 401 699). For this purpose, devices not shown in the drawing are provided such as a winding arm which moves around the drum as well as detectors which detect the quantity of yarn stored, so that the speed of winding is controlled. In addition, transport means are provided in the surface of the drum which transport the thread turns deposited on the surface of the drum in the take-off direction. The thread F is pulled out through the thread take-off eye 5. The thread take-off eye is positioned on the axis of the drum 1. It is displaceable in the axial direction x.

The drum shown in FIGS. 1 and 2 has a storage region which is of cylindrical shape. At its end, a frustoconical braking surface 4 constituting and edge region of the drum on the thread take-off side adjoins this storage region. The theoretical tip of the conical frustrum of the brake surface 4 forms position III of the eye 5, which is the position furthest from the end surface of the storage drum 1. The frustoconical surface 4 passes in the direction x of the withdrawal of the thread into a toroidal surface 3. This surface 3 is characterized by the fact that it is curved inward in the shape of a segment of a circle, as seen in cross section. As can be noted, in particular, from FIG. 2, the different axial positions of the take-off eye 5 I, II correspond to different angles of application alpha 1, alpha 2 of the thread F on the radially inwardly curved surface 3. Depending on the size of the angles alpha 1, alpha 2, the rubbing of the thread on this portion of the surface changes. The surface of the drum is smooth in this region.

A brake strip 2 lies on the conical section 4 of the surface of the drum 1. The brake strip 2 is made of a thin metal foil and forms a frustoconically shaped inner surface with which the brake member 2 rests flat on the surface 4. The brake member 2 is held by an annular plastic member 7. The plastic is in this case developed as an elastic foam so that the annular strip 2 can move away elastically.

By an axial displacement of the brake ring 8 which carries the brake strip 2, the force of the application of the brake strip 2 onto the surface 4 can be adjusted. In this connection, the brake ring is arranged axially displaceable with a mount 12 on a support 10. The force of application of the brake strip 2 on the mating surface 4 is so dimensioned that the brake force is minimum. The brake force should be just large enough that no ballooning is formed upon the withdrawal of the thread. The brake ring therefore merely serves to control ballooning. The angle beta, which corresponds to the cone angle of the frustoconical brake surface 2, 4, is preferably an acute angle. In this way, the spectrum of the application angles alpha 1, alpha 2 is maximized.

Similarly, the spectrum of the application angles beta 1, beta 2 (FIG. 5) in the region of the thread take-off eye 5 is made maximum. The change in the two application angles alpha and beta takes place, by design, in the same direction. A reduction in the distance between eye 5 and drum 1 increases both the application angle alpha and the application angle beta, and thus the frictional force as a whole.

As a result of the variability of the distance from the eye to the thread brake or storage drum, the application of the thread onto a radially inwardly curved section 3 of the drum is adjustable as is the application of the thread onto a curved wall region of the take-off eye 5.

Figures 3, 5:
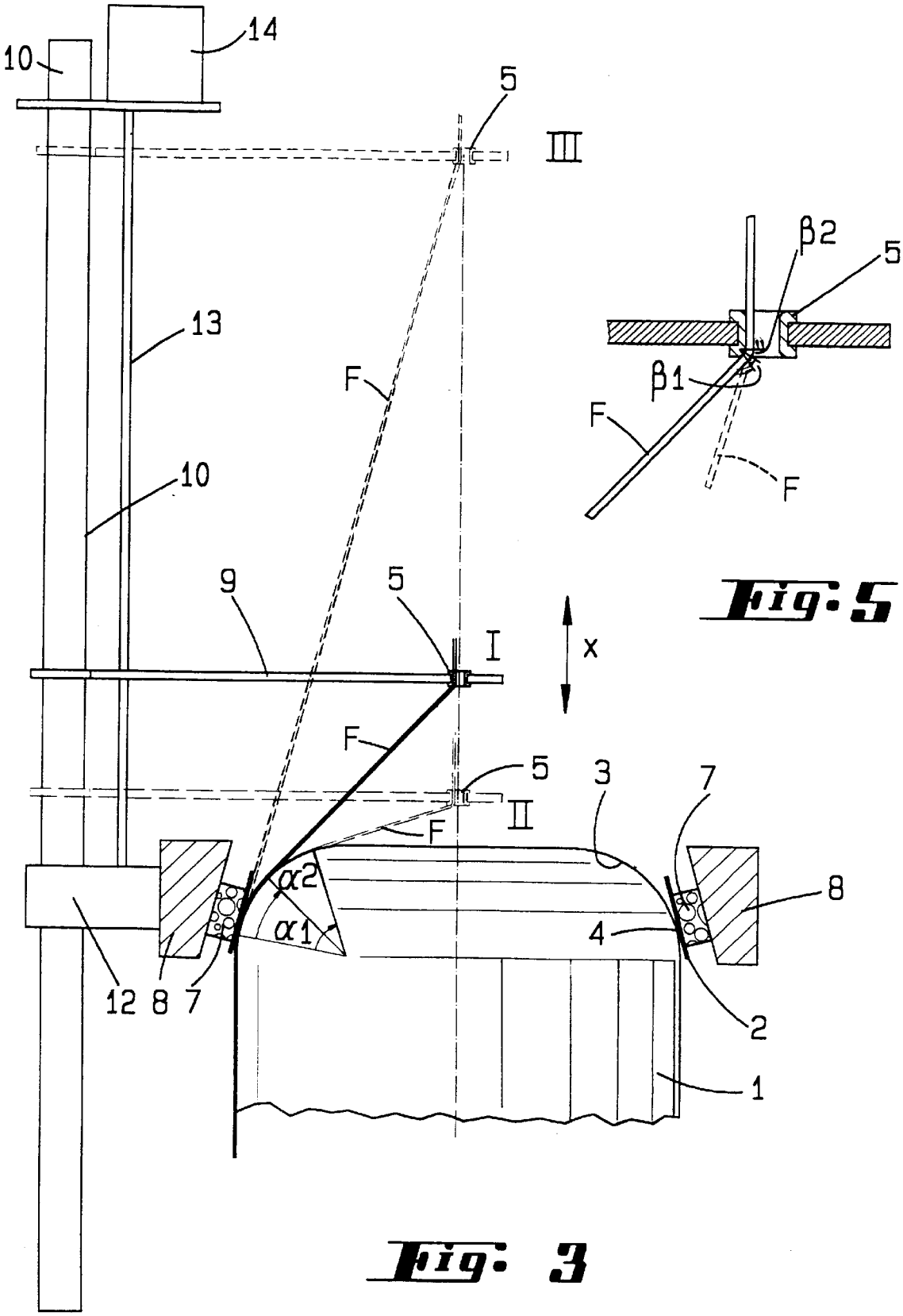
FIG. 3 shows an elevational view of a second embodiment of the invention broken away and sectioned in part.
FIG. 5 is an enlarged sectional view showing of the take-off eye in the case of the second embodiment.

In the embodiment shown in FIG. 3, the conical inner surface of the brake strip 2 does not rest on a frustoconical surface but on a curved surface 4, as the edge region of the drum on the thread take-off side. The surface, 4 describes a quarter of a circle as seen in cross section. It changes from the wall surface of the storage drum 1 into the flat end surface of the storage drum 1. To this extent, there is a linear application here of the brake strip 2 on the storage drum 1. Since the brake strip 2 rests with minimum force on the surface of the drum, there is little danger here of washboard-like deformations being developed in the elastically bendable brake strip 2.

The thread take-off eye 5 is associated with an arm 9 which can be displaced along the support 10 by a knurled screw 11 or an electric motor 14. In this connection, as shown diagrammatically in the embodiment, a spindle 13 can be provided by the rotation of which the axial position of the arm 9 can be adjusted. The arm 9 can be displaced from a maximum position III which is furthest away to a minimum position II which is the closest. An intermediate position is indicated by the position marked I. In the position of the thread take-off eye designated III, the thread leaves the brake surface of the brake strip 2 in tangential direction. The angle of application on the curved surface 3 is then extremely small. If now the thread take-off eye 5 approaches the end surface of the drum 1 by displacement in direction x—either by actuation of the knurled wheel 11 or of the electric motor 14—the angle of the thread F becomes more and more obtuse, with the result that the angle with which the thread F rests on the surface 3 of the drum becomes greater. This increase in the angle alpha 1 to alpha 2 effects an increase in the braking of the thread.

Figure 4:
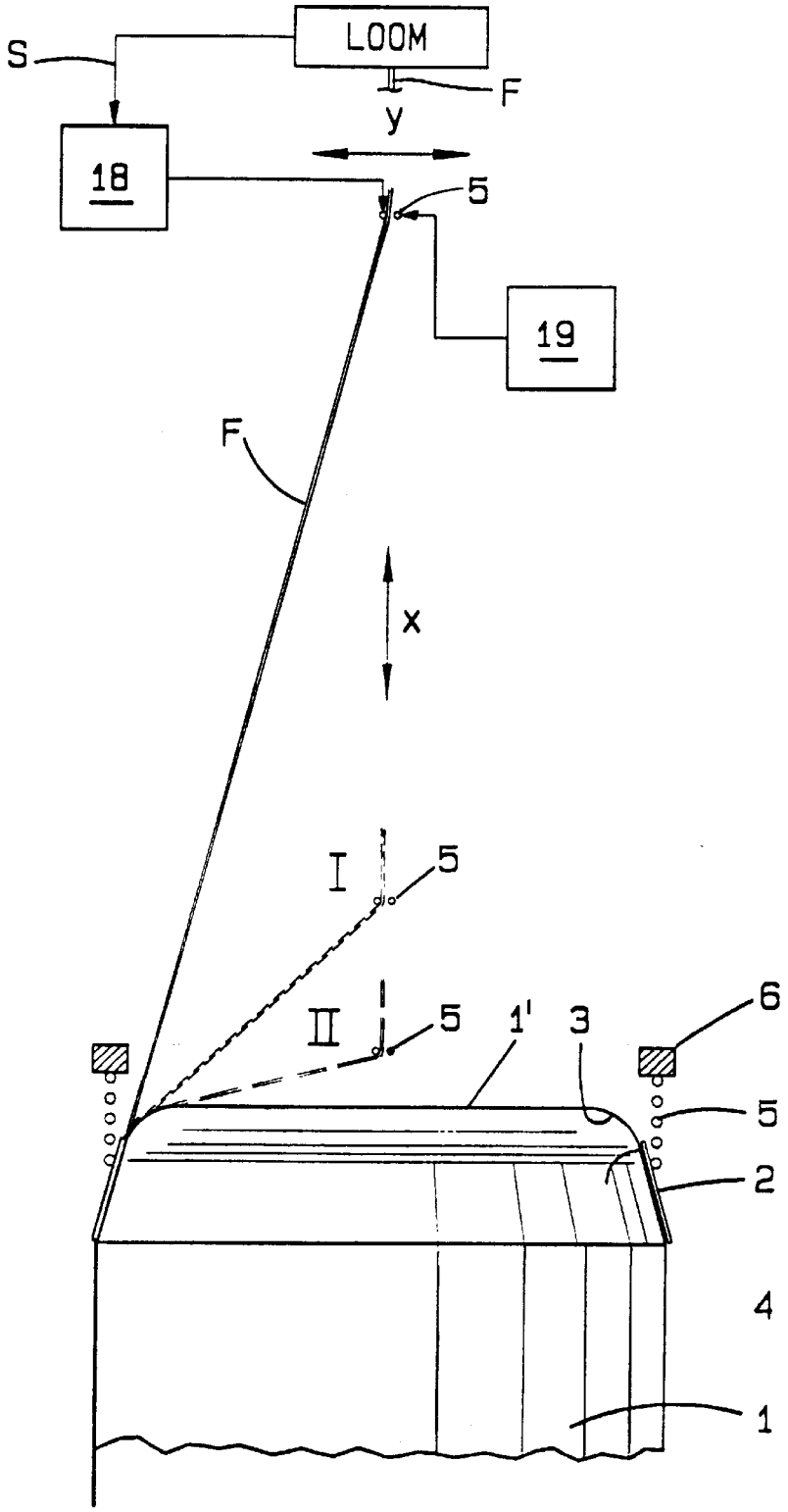
FIG. 4 shows an elevational view of a third embodiment of the invention broken away and sectioned in part.

In the embodiment shown in FIG. 4, a brake strip 2 is held on the mating brake surface 4 of the drum by a coil spring 15 which is arranged on an axially displaceable brake ring 6. The mating brake surface 4 is of frustoconical shape. There is thus surface application of the two brake surfaces 2,4 on each other.

The thread eye 5 is axially displaceable in the direction x. This diagrammatically shown axial displaceability of the thread take-off eye is to be effected by means of an electromagnet 18 or a rapidly rotating motor so that it can take place in synchronism with the introduction of the filling thread in a loom. In this way, the braking of the thread can be controlled by a loom. The control signals for the drive of the displacement mechanism can then be obtained from the loom.

It is furthermore provided that the thread take-off eye 5 be displaceable in the direction of a surface which is perpendicular to the axis of the drum by a displacement device 19. By displacing the thread take-off eye 5 in this direction (y), take-off forces which vary periodically with respect to the circumference can be established.

I claim:

1. A thread storage device according to claim 1, wherein the storage drum is stationary; and a winding arm is movable around the drum, said winding arm constitutes means for providing the supply of thread on the storage drum.

* * * * *